US007265325B2

(12) United States Patent
Herzog

(10) Patent No.: US 7,265,325 B2
(45) Date of Patent: Sep. 4, 2007

(54) CAP SEALER WITH A GRADUATED POWER DISPLAY

(76) Inventor: Kenneth J. Herzog, 200 Mill Rd., Riverhead, NY (US) 11901-3125

( * ) Notice: Subject to any disclaimer, the term of this patent is extended or adjusted under 35 U.S.C. 154(b) by 74 days.

(21) Appl. No.: 10/860,753

(22) Filed: Jun. 2, 2004

(65) Prior Publication Data

US 2005/0252172 A1 Nov. 17, 2005

Related U.S. Application Data

(60) Provisional application No. 60/572,027, filed on May 17, 2004.

(51) Int. Cl.
*H05B 6/06* (2006.01)
*G05G 15/00* (2006.01)

(52) U.S. Cl. ..... 219/633; 219/663; 219/665; 219/506; 156/69

(58) Field of Classification Search ..... 219/633–635, 219/661–667, 720, 506; 156/379.6, 69, 380.2
See application file for complete search history.

(56) References Cited

U.S. PATENT DOCUMENTS 4,149,217 A * 4/1979 Tucker ..... 361/644
4,206,336 A * 6/1980 Cunningham ..... 219/622
4,404,461 A * 9/1983 Sitek et al. ..... 219/490
4,686,340 A 8/1987 Fukasawa
4,687,195 A 8/1987 Potts
5,025,123 A * 6/1991 Pfaffmann et al. ..... 219/604
RE34,959 E 5/1995 Potts
5,434,389 A 7/1995 Griebel
5,952,820 A 9/1999 Thrasher et al.
6,198,080 B1 3/2001 Rice et al.
6,288,365 B1 * 9/2001 McAmmond et al. ..... 219/229
6,354,996 B1 3/2002 Drinan et al.
6,429,869 B1 8/2002 Kamakura
6,509,555 B1 * 1/2003 Riess et al. ..... 219/633
6,762,917 B1 * 7/2004 Verbiest et al. ..... 361/42

FOREIGN PATENT DOCUMENTS

DE 41 27 156 * 2/1993 ..... 228/51
JP 2001-31024 * 2/2001

* cited by examiner

*Primary Examiner*—Philip H. Leung
(74) *Attorney, Agent, or Firm*—Ostrolenk, Faber, Gerb & Soffen, LLP

(57) ABSTRACT

An induction foil cap sealer which includes a visual display device that shows power consumption in a bar graph format.

18 Claims, 7 Drawing Sheets

CAP SEALER WITH A GRADUATED POWER DISPLAY

CLAIM OF PRIORITY AND RELATED APPLICATIONS

The present application is based on and claims priority to U.S. Provisional Application No. 60/572,027, filed on May 17, 2004, in the name of Kenneth J. Herzog, and entitled A BAR GRAPH DISPLAY, AN IR THERMOMETER, AND A SPEED SENSOR WHICH CAN BE USED INDIVIDUALLY OR IN COMBINATION WITH AN INDUCTION SEALER, the disclosure of which is hereby incorporated by reference.

This application is related to U.S. Application Ser. No. 10/860,756, filed concurrently with the present application in the name of Kenneth J. Herzog, and entitled CONVEYOR SPEED MONITOR, the disclosure of which is hereby incorporated by reference.

This application is also related to U.S. Application Ser. No. 10/859,830, filed concurrently with the present application in the name of Kenneth J. Herzog, and entitled INDUCTION SEALER SYSTEM WITH TEMPERATURE SENSOR, the disclosure of which is hereby incorporated by reference.

FIELD OF THE INVENTION

The present invention relates to induction foil cap sealers and more particularly to a power consumption display device associated with an induction foil cap sealer.

BACKGROUND OF THE INVENTION

Induction foil cap sealers are well known. Referring to FIG. 1, a prior art induction foil cap sealer includes induction head 10 which includes a plurality of field coils 12. In operation, field coils 12 receive an electrical current which causes the development of magnetic fields that project away from field coils 12. The projected magnetic fields are schematically shown as circular lines surrounding field coils 12 for illustration purposes only. The magnetic fields projecting from field coils 12 are used for sealing a cap onto an opening of a bottle in the following manner.

Cap 14 is mechanically coupled to the opening of bottle 16 and placed under induction head 10. Due to the mechanical coupling between cap 14 and bottle 16, metallic foil 18, which is received in cap 14, is pressed between the end of cap 14 and the sealing edge of the opening of bottle 16. Included inside cap 14 is polymer sealing film 17 which is interposed between metallic foil 18 and the opening of bottle 16. Optionally, wax layer 20 and pulp board liner 22 are also included in cap 14 and sandwiched between metallic foil 18 and the closed end of cap 14.

To effect the seal, magnetic fields that project from field coils 12 permeate cap 14 and cause foil 18 to heat up. The heat so generated causes polymer sealing film 17 to melt and thus seal metallic foil 18 to the opening of bottle 16. As a result, a hermetic seal between metallic foil 18 and bottle 16 is obtained which can survive the removal of cap 14. If optional wax layer 20 is used, the generated heat melts wax layer 20 further enhancing the hermetic effect.

Induction head 10 may assume any number of shapes depending on the type of cap used. FIGS. 2A-2C illustrate three examples of induction heads.

Referring to FIG. 3, in a typical induction sealing operation, a series of bottles 16 are transported on a conveyor belt 24 under an induction head 10. Induction head 10 is included as part of induction sealer 27 and is positioned over conveyor belt 24. The number of bottles 16, the spacing of bottles 16, the space between cap 14 of a bottle 16 and induction head 10, and the speed of conveyor belt 24 can be selected to obtain the necessary heating for a proper seal for bottles 16 as they pass under induction head 10.

The sealing of each bottle 16 consumes an amount of power. As a plurality of bottles 16 pass under induction head 10 the power consumed is increased proportionally. Thus, as the number of bottles increases, and/or the spacing of bottles decreases, and/or the speed of the conveyor belt 24 increases more power is demanded by induction head 10. The amount of power demanded may also increase if the area of each metallic foil 18 is enlarged, i.e., when bottles 16 with larger openings are subjected to induction heating.

If the power demanded from induction head 10 exceeds the maximum power that induction head 10 is capable of providing, the quality of the hermetic sealing may be adversely affected due to insufficient power per bottle. Thus, quality control is sacrificed, which is commercially undesirable.

It is desirable to have a feature for monitoring the power consumption during sealing so that appropriate action can be taken in the event insufficient power is supplied to the bottles.

SUMMARY OF THE INVENTION

It is an object of the present invention to provide an induction foil cap sealer that includes a visual display to display power consumption.

According to the present invention an induction foil cap sealer includes a visual display operatively connected to a current detector which detects the current supplied to the induction head. The detected current is proportional to the power supplied to the induction head and is displayed by the visual display.

According to an aspect of the present invention the visual display is graduated. That is, the visual display includes a plurality of visual indicators. Each visual indicator may be an LED associated with a power level which generates a visual signal when its associated power level is reached.

According to another aspect of the present invention, the visual indicators are arranged in a bar graph format. That is, the visual indicators are arranged in a column and generate visual signals sequentially in response to the increase in the supply of power.

According to one other aspect of the present invention visual indicators in a visual display according to the present invention sequentially generate visual signals according to a logarithmic scale, as opposed to a linear scale.

According to one embodiment of the present invention the visual indicators in a visual display according to the present invention are grouped into several different colors.

Other features and advantages of the present invention will become apparent from the following description of the invention which refers to the accompanying drawings.

DETAILED DESCRIPTION OF THE INVENTION

Figure 1:
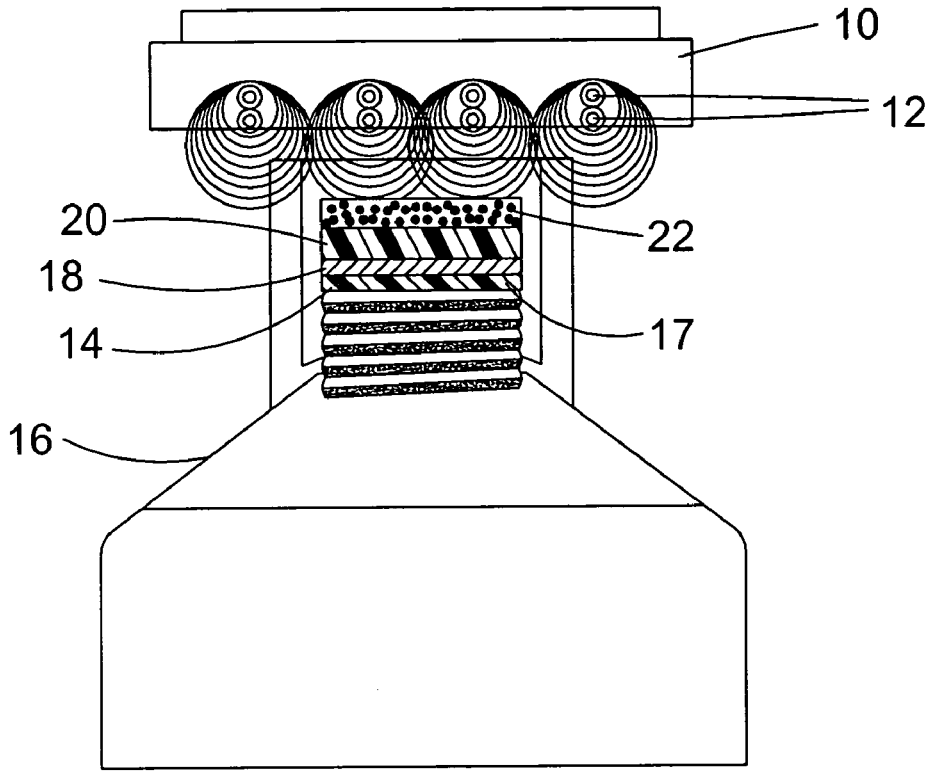
FIG. 1 (prior art)
FIG. 1 schematically illustrates cap foil sealing by an induction head according to the prior art.
Figure 2A:
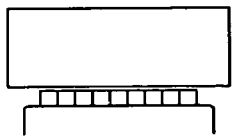
FIG. 2A (prior art)
FIGS. 2A-2C illustrate schematically a plurality of induction heads according to the prior art.
Figure 2B:
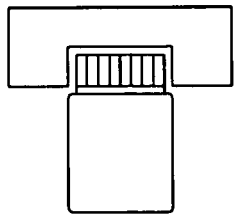
FIG. 2B (prior art)
Figure 2C:
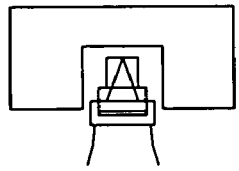
FIG. 2C (prior art)
Figure 3:
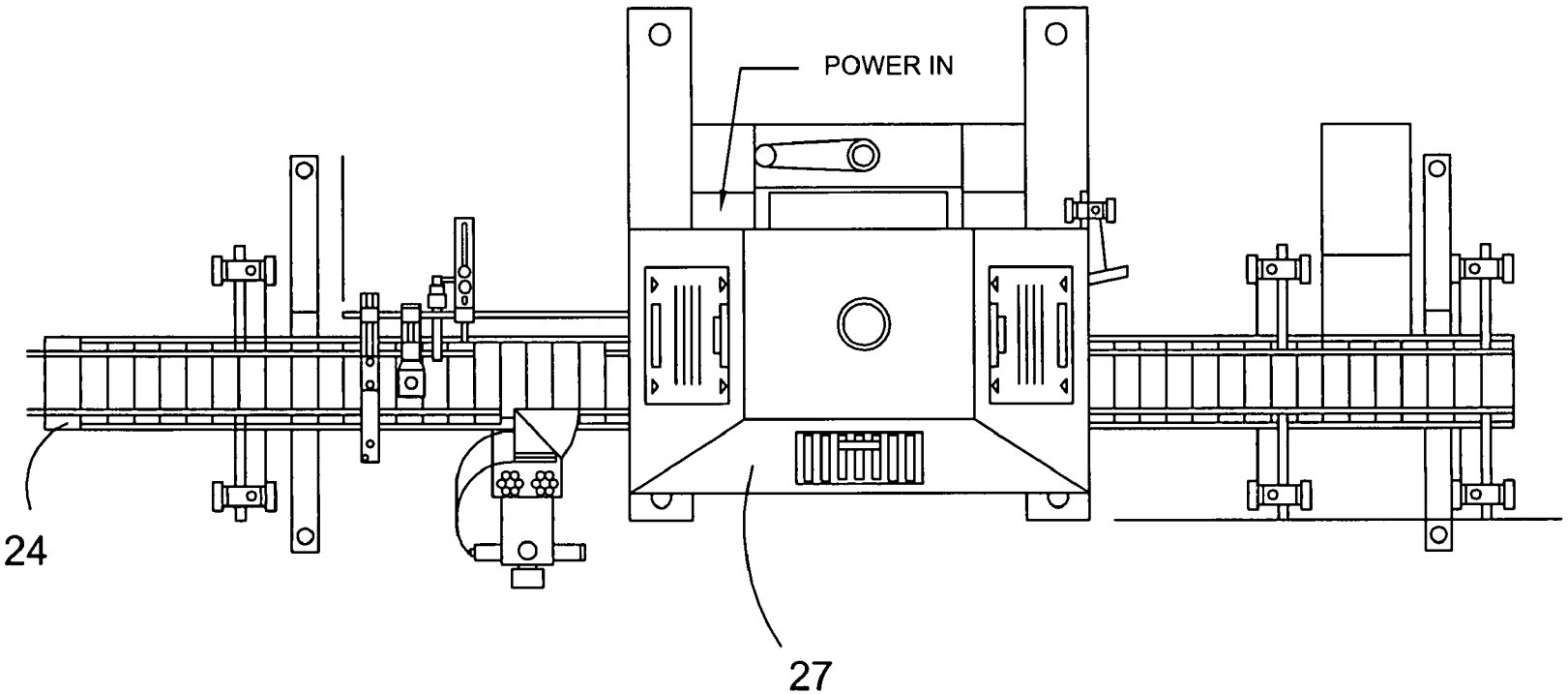
FIG. 3 (prior art)
FIG. 3 schematically illustrates an induction foil sealing system according to the prior art.
Figure 4:
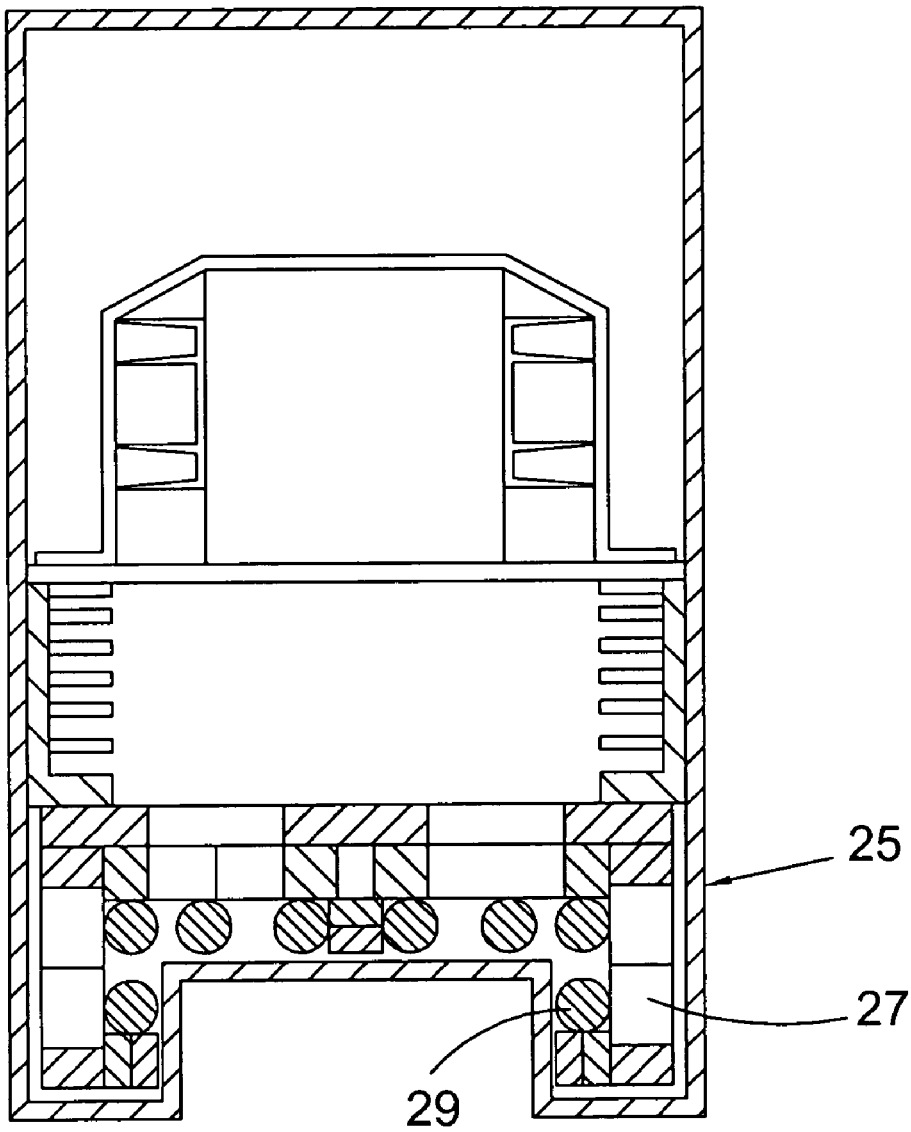
FIG. 4 (prior art)
FIG. 4 schematically illustrates an example of an induction head according to the prior art.

Referring now to FIG. 4, a typical induction head 10 includes ferrite core 25. Ferrite core 25 includes a plurality of ferrite elements 27. Each ferrite element serves as a field coil. Disposed against ferrite elements 27 is a litz wire coil 29. Litz wire coil 29 receives a high frequency current from a power supply unit which generates the magnetic field necessary for induction heating. Further details regarding ferrite core 25 shown in FIG. 4 can be found in U.S. Pat. No. 6,633,480, the entire disclsoure of which is incorporated by reference.

Figure 5:
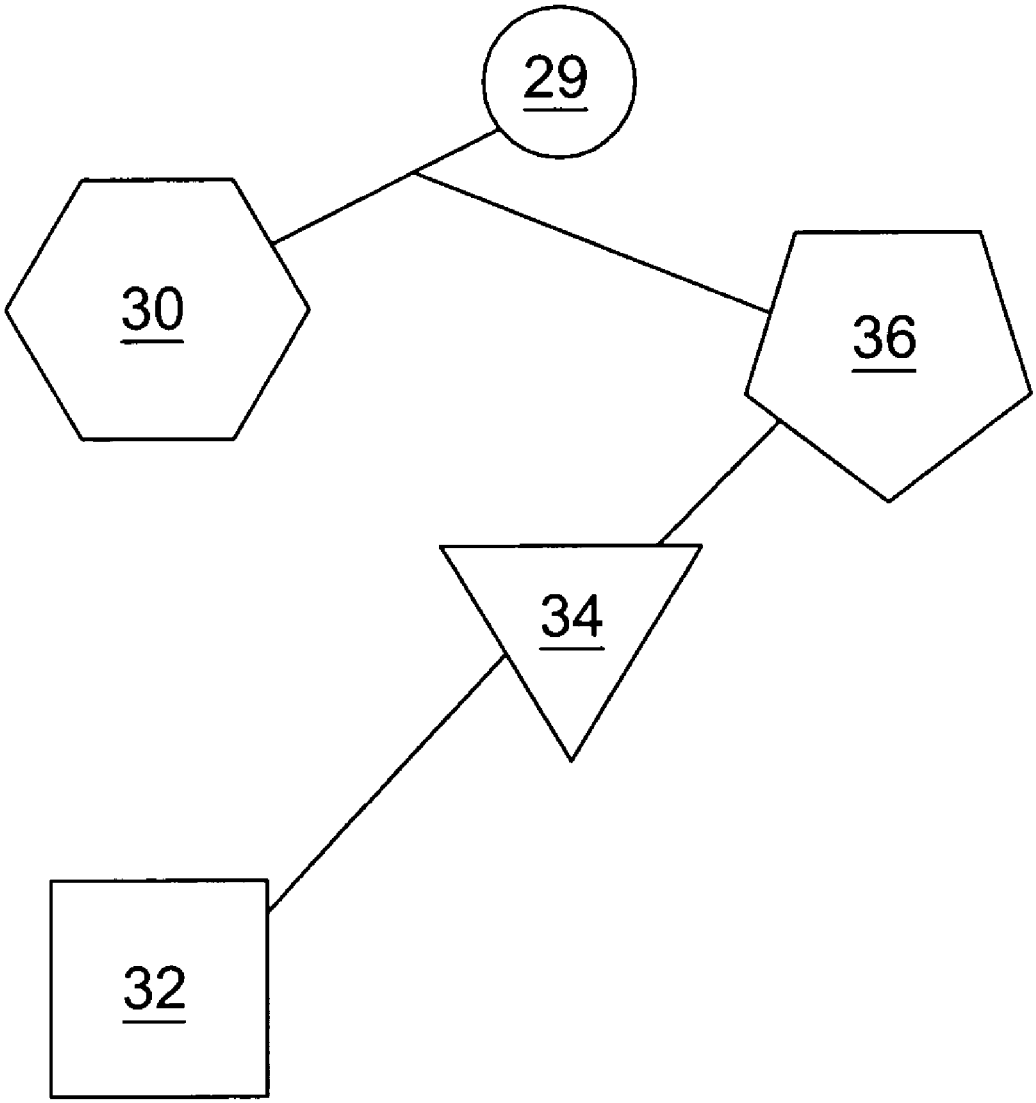
FIG. 5 shows a diagram that illustrates a power consumption display system according to the present invention.

Referring now to FIG. 5, power supply 30 is operatively connected to litz wire coil 29 in order to supply power to the same. Power supply 30 is preferably capable of pulse width modulation. As is well known, pulse width modulation allows for the control of power supplied by varying the duration (i.e. the width) of a current signal. Thus, for example, if more current is required, the duration of a current pulse is increased in order to supply more power to a load. U.S. Pat. No. 6,412,252 describes an example of a power supply scheme which can be used in an induction foil sealer according to the present invention. The entire disclosure of U.S. Pat. No. 6,412,252 is incorporated by this reference.

According to the present invention, power supplied to induction head 10 from power supply 30 can be visually monitored. Specifically, visual display 32 is in communication with display controller 34 which provides signals to visual display 32 that are indicative of the power that is supplied to induction head 10.

In the preferred embodiment of the present invention, current detector 36 detects the current supplied from power supply 30 and provides signals to display controller 34 that are related to the amount of current that is being detected.

Also, in the preferred embodiment, power supply 30 can selectively operate at any portion of its maximum power output. For example, power supply 30 may selectively operate at 5% to 100% of its maximum power output.

Specifically, for example, the power setting may be set at 50% of the maximum power output of 3000 watts. Thus, the power setting may be set at 1500 watts. At the 50% power setting, current may be increased as power demand increases by the load until 1500 watts is supplied.

Figure 6:
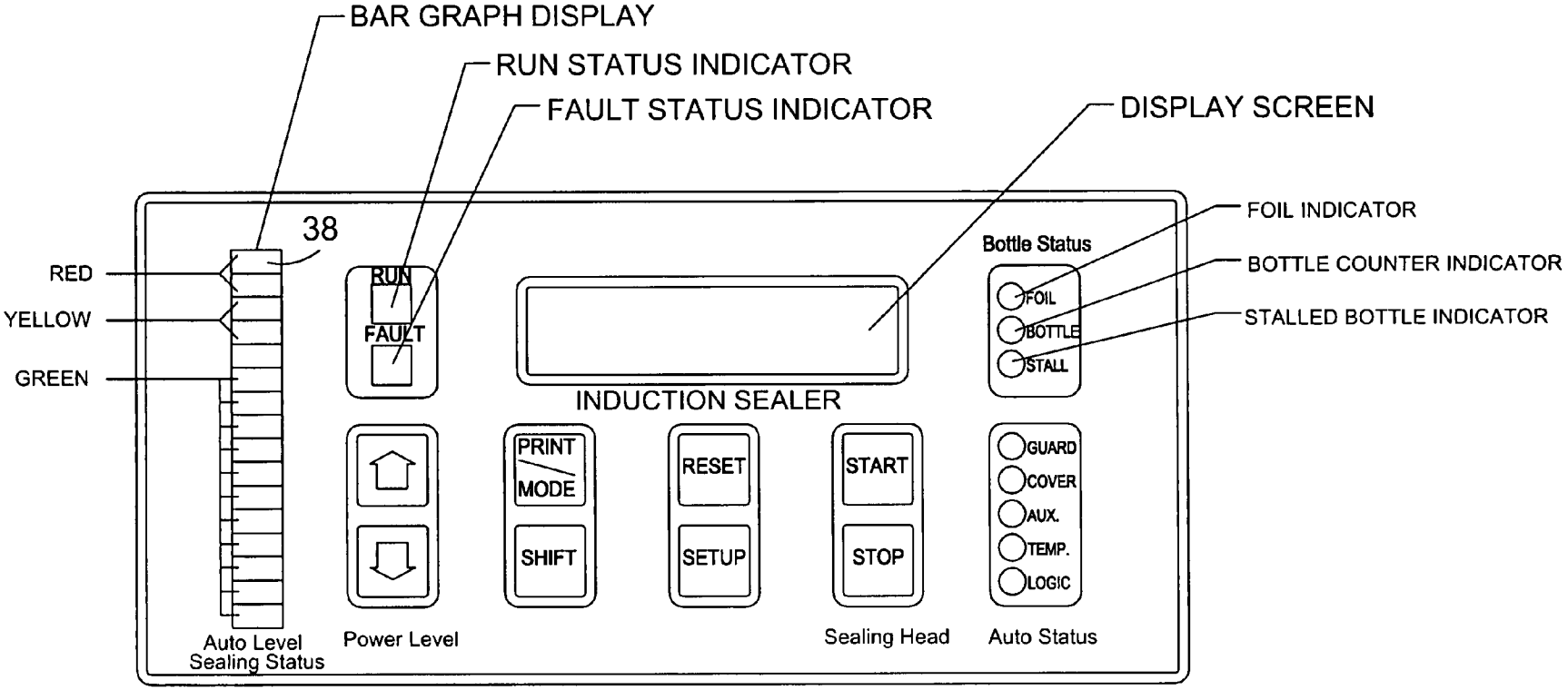
FIG. 6 shows an example of a control panel including a bar graph display according to an embodiment of the present invention.

According to the present invention, visual display 32 provides visual indications of the power consumption. Referring to FIG. 6, visual display 32 according to one aspect of the present invention is arranged in a bar graph format. To obtain such an arrangement, a plurality of visual indicators 38 are disposed adjacently to form a column of indicators 38.

Each visual indicator 38 in the preferred embodiment may be an LED. Display controller 34 in the preferred embodiment of the present invention is capable of controlling the operation of the LEDs.

In one embodiment, the LEDs in the preferred embodiment may be grouped into several colors. For example, several LEDs may be colored green, several others may be colored yellow, and the remaining LEDs may be colored red. Each LED in the preferred embodiment may correspond to a specific power level. As a result, information related to power consumption is displayed in a graduated format, whereby as power consumption increases LEDs are lit sequentially to indicate rise in power consumption.

A benefit of using a graduated display is that an operator can see the rising power consumption from a distance so that he/she may take appropriate action when the power drawn gets close to the maximum power allowed under the selected power setting. Thus, for example, when display 32 indicates that power consumption has reached a maximum level, the operator can either increase the power setting or decrease the number of bottle caps with seals to reduce the load in order to avoid having low quality sealing. This feature is enhanced by having visual indicators 38 (e.g. LEDs) of different colors in that a particular color (e.g. red) can be set to correspond to high power consumption levels so that the operator can from a distance appreciate that power consumption is reaching (or has reached) an undesirable level. Thus, a graduated display 32 provides an operator the opportunity to receive information about power consumption from a distance without the need to be close enough for reading, for example, a dial.

Figure 7:
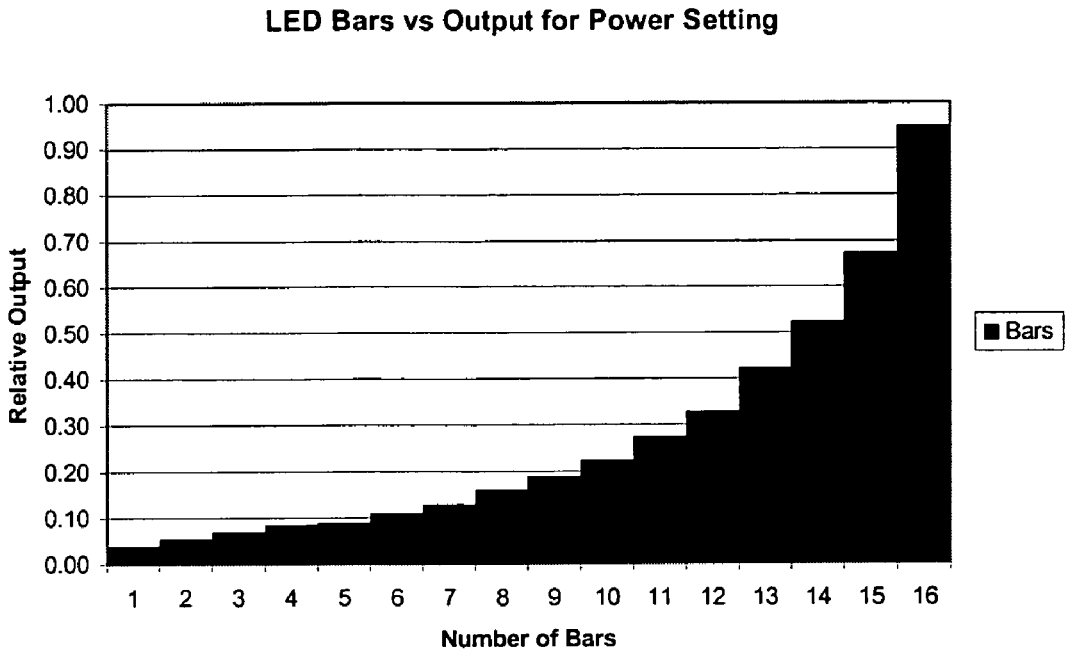
FIG. 7 graphically illustrates a scale for displaying the power output of an induction sealing head according to an aspect of the present invention.

Referring now to FIG. 7, according to one aspect of the present invention each power level (defined herein as a fraction of the total power for a given power setting) associated with each visual indicator 38 is determined based on a logarithmic scale. Thus, for example, the fourth visual display 38 from the bottom is lit only after a fraction of change in the power; whereas, the last visual indicator 38 (e.g. the sixteenth LED in the preferred embodiment) is lit after about 30% increase in power from the previous power level.

In the preferred embodiment a logarithmic-type curve is plotted with a look-up table with ninety five points. The logarithmic curve used in the present invention is preferably adapted to show a lot of sensitivity for small changes at the lower end of the power scale and it becomes less sensitive to the large changes at the higher end of the power scale so that a dynamic range of values can be represented using a small bar graph with relatively few visual indicators. Thus, the logarithmic type curve allows a very wide dynamic range to be displayed with only a few points (e.g. 16 bars or 16 LEDs).

The use of a logarithmic scale (as opposed to a linear scale) is advantageous in that it allows for the display of information about the entire dynamic range of power using fewer visual indicators 38 (e.g. fewer LEDs). Thus, the visual feedback can be provided for very small foil targets (small caps) while accommodating the much greater foil area of larger caps under the head without saturating the display. As a result, the sensitivity under little or no load (no foil area or small foil area) is high and progressively decreases as the current load to the head increases (large foil area).

Figure 8:
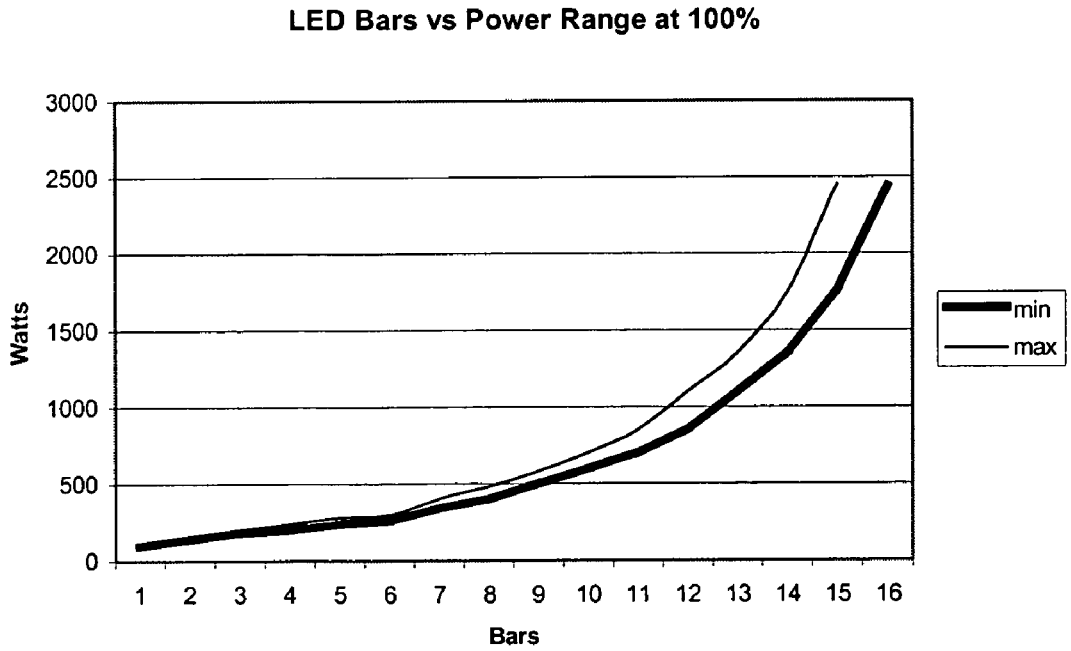
FIG. 8 graphically illustrates a power output display scheme according to the present invention.

In a display device according to the present invention the number of visual indicators 38 that are lit increases as the load increases. Specifically, the number of visual indicators that are lit will depend on the number of caps under the induction head, the size of the caps under the head, and the spacing of caps under the head (i.e. the total foil area). FIG. 8 shows the power values for a 100% power setting. In the example shown in FIG. 8, the power shown is the actual amount delivered to an increasing load from no load to full load. The Min and Max lines on the graph show the range of power values required to activate the visual indicators 38 (e.g. LEDs in the preferred embodiment).

In the preferred embodiment of the present invention, a calibration procedure is carried out to determine the power output for an unloaded condition at each selected power setting. Calibration may be required because there may be slight differences between each sealing head. For example, there may be differences in resistance, etc. Furthermore, calibration may be desirable in that it may allow the determination of the best resonant frequency of the sealing head in order to optimize its operation and performance.

The power output during an unloaded condition for each power setting is preferably used to activate one or possibly two of visual indicators 38 in display 32. For example, power output during an loaded condition for all power settings from 5% to 100% is determined during the calibration procedure, and the value so obtained for each power setting is used to activate one or possibly two visual indicators 38 at each given power setting to indicate that the head is unloaded.

During the calibration procedure, the power controller builds a table of pulse-widths which are related to the unloaded output for each power setting. Specifically, in the preferred embodiment, at a given line voltage, a number of nominal pulse widths are generated, sampled and averaged together to obtain a nominal pulse width value. This process is repeated for each power setting to obtain a nominal pulse width value for each power setting. For example, a nominal pulse width value is determined for each power setting between 0 to 100% in 5% increments. The values so obtained are then assembled in a table in which the nominal pulse width value is related to a given power setting.

If, during the operation, the sealer head requires more power in order to maintain the power output at the selected power setting the pulse width is increased. Then, the nominal pulse width value is compared to the actual pulse width (the pulse width of the output), and the difference between the two is used the determine the correct bar graph display using, preferably, a logarithmic scale.

Furthermore, the calibration procedure dynamically builds and stores a table of line voltages for all power settings from 5% through 100% and normalizes the output of display 32 to work correctly at that line voltage. Variation in the line voltage can adversely affect the accuracy of the information displayed by display 32. The values in the table are used as a reference by the power controller to compensate for variation in the line voltage. Also, the values may be used as a reference value for setting the initial power values, thereby improving the accuracy of the information displayed by display 32.

Figure 9:
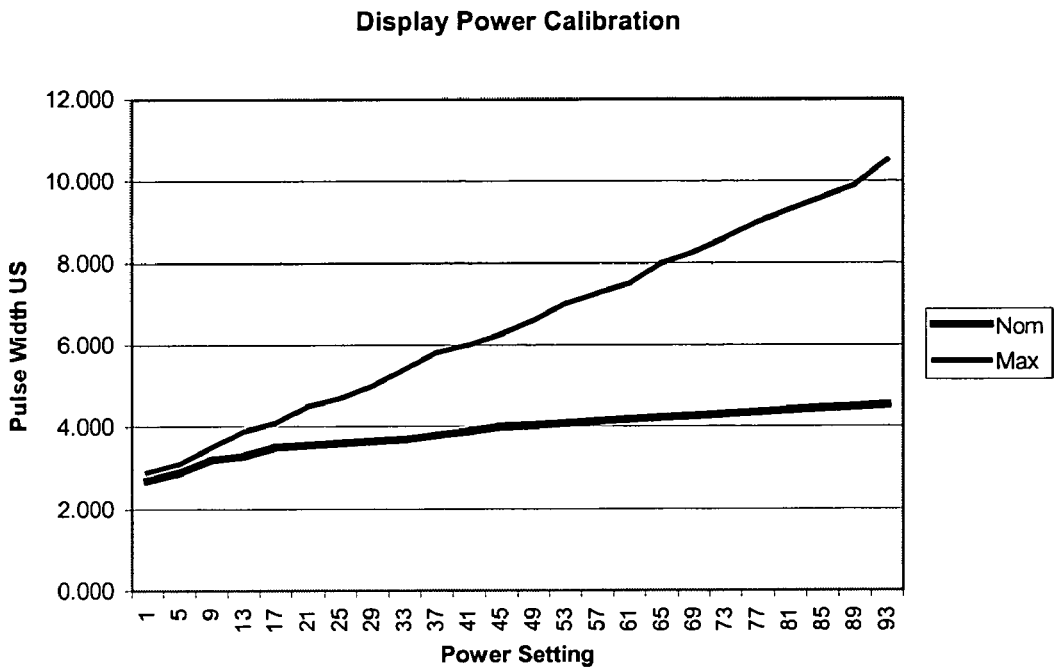
FIG. 9 graphically illustrates power output calibration in an induction foil sealer at a plurality of power settings each power setting being a fraction of the maximum power output.

The calibration procedure only affects the properties of display 32, and does not affect the actual power output. That is, the calibration does not vary the output. The actual power output is adjusted by the power controller. An example of a suitable power controller can be found in U.S. Pat. No. 6,412,252. As an example, FIG. 9 illustrates an example of nominal (Nom) and maximum (Max) pulse width values for a range of power settings.

In an apparatus according to the present invention, calibration is preferably repeated every time a sealing head is changed from one size (e.g. 70 mm, 89 mm, 120 mm, etc.) or type (e.g. tunnel, flat, etc.) to another. Also, calibration is carried out whenever a component of the sealing head (i.e. Capacitor), power board, power supply or any other major electrical component is changed, when the cap sealer is moved from one location to another, or when different power source is employed.

Preferably, whenever two or more visual indicators 38 are lit without a load (i.e. no caps under the sealing head), calibration should be repeated.

Figure 10:
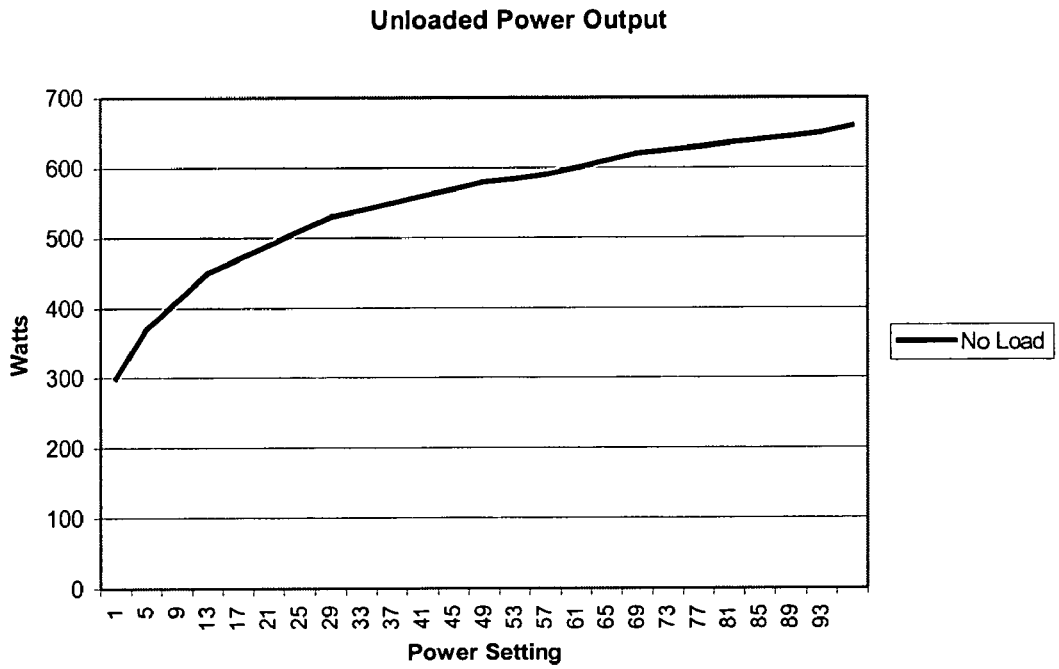
FIG. 10 graphically illustrates the power output in an induction foil sealer at a plurality of power settings each power setting being a fraction of the maximum power output.

In the preferred embodiment, when no workpiece (e.g. bottle) is supplied (unloaded condition) most of the power that is consumed is due to losses in the electrical components, for example, the induction head, the wiring, and other power output components. When a workpiece (e.g. bottle) is supplied the presence of metallic foil 18 results in greater efficiency and substantial reduction in loss. FIG. 10 graphically shows examples of power output values for a range of power settings during an unloaded condition.

A display 32 according to the present invention is preferably operated in the following manner. When the power is OFF, no visual indicator 38 is lit. When the power is ON, the number of segments lit will be based on the amount of current being supplied to the induction head to maintain the power at the selected power setting, based on the practical maximum for that power setting. When no work pieces are supplied (unloaded condition) display 32 will have only one or at most two visual indicators 38 lit at the bottom. It is preferred to have at least one lit visual indicator 38. As the number of workpieces increases, the current drawn from the system will increase and thus the number of segments lit will increase. The maximum number of segments lit will approximately correspond to 100% of the selected power setting.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A power consumption monitor in a cap sealer including an induction head, said monitor comprising:

a current detector that detects the current supplied to said cap sealer; and a graduated display in communication with said current detector, said display including a plurality of visual indicators;

wherein each visual indicator corresponds to a power level, said power levels are based on a logarithmic scale, the number of activated visual indicators corresponds to the total foil area under the induction head of said cap sealer, and said graduated display is normalized to the line voltage.

2. A power consumption monitor according to claim 1, wherein said visual indicators are LEDs.

3. A power consumption monitor according to claim 2, wherein said LEDs are grouped into several different colors.

4. A power consumption monitor according to claim 3, wherein each of said colors is associated with a range of values of power levels.

5. A power consumption monitor according to claim 1, wherein said visual indicators are arranged in a bar graph format.

6. A power consumption monitor according to claim 1, wherein said supplied current depends on the number of work pieces treated under said cap sealer.

7. A power consumption monitor according to claim 1, wherein the total foil area depends on the number of caps under the induction head, the type of induction head and the spacing of the caps under the induction head.

8. An induction foil cap sealer comprising:

at least one electrically operated induction cap sealer, said cap sealer including an induction head;

a power supply including a current supply that supplies current to said at least one electrically operated induction cap sealer;

a current detector that detects the current supplied to said at least one electrically operated induction cap sealer; and a power supply display meter in communication with said current detector, whereby said power supply display meter visually displays indications of power consumption, wherein said indications of power consumption are based on total foil area of work pieces treated under said induction head of said foil cap sealer.

9. An induction foil cap sealer according to claim 8, wherein said display meter includes a plurality of visual indicators each indicator corresponding to a power level.

10. An induction foil cap sealer according to claim 9, wherein said visual indicators are LEDs.

11. An induction foil cap sealer according to claim 10, wherein said LEDs are grouped into several different colors.

12. An induction foil cap sealer according to claim 11, wherein each of said colors is associated with a range of values of power levels.

13. An induction foil cap sealer according to claim 9, wherein said visual indicators are arranged in a bar graph format.

14. An induction foil cap sealer according to claim 8, wherein said power supply is a pulse width modulated power supply.

15. An induction foil cap sealer according to claim 8, wherein said power supply includes a feature for setting maximum power supplied to said induction foil cap sealer.

16. An induction foil cap sealer according to claim 15, wherein said power levels logarithmically increase between a minimum power and said maximum power.

17. An induction foil cap sealer according to claim 16, wherein said minimum power corresponds to power supplied to said induction foil cap sealer in absence of a work piece.

18. An induction foil cap sealer according to claim 8, wherein said power supply display meter is calibrated based on sealer size, sealer type and line current.

* * * * *